US011105131B2

(12) United States Patent
Garry

(10) Patent No.: US 11,105,131 B2
(45) Date of Patent: Aug. 31, 2021

(54) GIRDER TROLLEY

(71) Applicant: Matthew Garry, Toowoomba (AU)

(72) Inventor: Matthew Garry, Toowoomba (AU)

(73) Assignee: OVERFLOW, LTD., Weatherford, TX (US)

( * ) Notice: Subject to any disclaimer, the term of this patent is extended or adjusted under 35 U.S.C. 154(b) by 14 days.

(21) Appl. No.: 16/666,123

(22) Filed: Oct. 28, 2019

(65) Prior Publication Data

US 2021/0123277 A1 Apr. 29, 2021

(51) Int. Cl.
*E05D 15/06* (2006.01)
*E06B 3/01* (2006.01)

(52) U.S. Cl.
CPC ..... *E05D 15/063* (2013.01); *E05D 15/0639* (2013.01); *E05D 15/0652* (2013.01); *E05Y 2201/428* (2013.01); *E05Y 2201/47* (2013.01); *E05Y 2201/474* (2013.01); *E05Y 2201/488* (2013.01); *E05Y 2201/622* (2013.01); *E05Y 2201/64* (2013.01); *E05Y 2600/13* (2013.01); *E05Y 2600/314* (2013.01); *E05Y 2900/108* (2013.01); *E05Y 2900/11* (2013.01); *E05Y 2900/132* (2013.01); *E06B 3/01* (2013.01)

(58) Field of Classification Search
CPC ..... E05D 15/063; E05D 15/0621; E05D 15/0665; E05D 15/0691; E05D 15/0673; E05D 15/0639; E05D 15/0652; E05Y 2900/132; E05Y 2900/108; E05Y 2201/64; E05Y 2201/47; E05Y 2600/13; E05Y 2600/314; E05Y 2201/622; E05Y 2900/11; E05Y 2201/428; E05Y 2201/474; E05Y 2201/488; E06B 3/4636; E06B 3/01
See application file for complete search history.

(56) References Cited

U.S. PATENT DOCUMENTS 1,767,448 A * 6/1930 Hall ..... E05F 15/649 49/264
2,759,226 A * 8/1956 McKee ..... E05D 15/405 49/140
3,085,298 A * 4/1963 Metzger ..... E05D 15/0691 49/417
3,108,547 A * 10/1963 Shaver ..... B61D 45/006 410/131
3,397,487 A * 8/1968 Hunt ..... E06B 3/924 49/130
3,416,183 A * 12/1968 Martin ..... E05D 15/0673 16/105

(Continued)

*Primary Examiner* — Brent W Herring
(74) *Attorney, Agent, or Firm* — Ferguson Braswell Fraser Kubasta PC

(57) ABSTRACT

A device. The device includes a shaft having a longitudinal axis, a first end, and a second end. The device also includes a connector attached to the first end of the shaft. The device also includes a rod connected to the shaft. The rod comprises a third end and a fourth end. The third end is connected to the second end of the shaft. The rod is about parallel to the longitudinal axis. The device also includes a spring surrounding the rod. The spring is compressible or extendable along the longitudinal axis. The device also includes a stop connected to the rod at a position distal to the spring. The stop resists longitudinal compression or extension of the spring.

15 Claims, 7 Drawing Sheets

(56) References Cited

U.S. PATENT DOCUMENTS

| | | | | | |
|---|---|---|---|---|---|
| 3,698,036 | A * | 10/1972 | Goodman | E05D 15/0665 | 16/100 |
| 4,406,034 | A * | 9/1983 | Lindemann | E05F 1/065 | 16/284 |
| 5,845,363 | A * | 12/1998 | Brempell | E05D 15/0669 | 16/105 |
| 6,098,695 | A * | 8/2000 | Schwingle | E05F 15/605 | 16/87 R |
| 8,156,992 | B2 * | 4/2012 | Diaz | E05F 15/643 | 160/201 |
| 9,187,941 | B2 * | 11/2015 | Therrien | E05D 15/0621 | |
| 2002/0162190 | A1 * | 11/2002 | Spork | E05D 15/26 | 16/91 |
| 2009/0282742 | A1 * | 11/2009 | Therrien | E06B 3/4636 | 49/425 |
| 2012/0247024 | A1 * | 10/2012 | Therrien | E05D 15/0621 | 49/425 |
| 2015/0308173 | A1 * | 10/2015 | Gazda | E05D 15/063 | 49/414 |
| 2016/0097228 | A1 * | 4/2016 | Wypych | E05D 15/0656 | 16/90 |
| 2017/0298668 | A1 * | 10/2017 | Lang | E05D 11/0018 | |
| 2019/0309551 | A1 * | 10/2019 | Hawkinson | E05D 15/0656 | |
| 2020/0270898 | A1 * | 8/2020 | Schaeffer | E05B 1/0046 | |

* cited by examiner

GIRDER TROLLEY

BACKGROUND

A variety of methods may be used to connect doors to buildings. In some cases, a horizontally sliding door is to be connected to a building.

SUMMARY

In general, in one aspect, one or more embodiments relate to a device. The device includes a shaft having a longitudinal axis, a first end, and a second end. The device also includes a connector attached to the first end of the shaft. The device also includes a rod connected to the shaft. The rod comprises a third end and a fourth end. The third end is connected to the second end of the shaft. The rod is about parallel to the longitudinal axis. The device also includes a spring surrounding the rod. The spring is compressible or extendable along the longitudinal axis. The device also includes a stop connected to the rod at a position distal to the spring. The stop resists longitudinal compression or extension of the spring.

The one or more embodiments also relate to a system. The system includes a door frame having a first beam about parallel to a second beam. The first beam and the second beam are about parallel to a longitudinal axis. The system also includes a first cross-beam connecting the first beam and the second beam. A first hole having a first radius is disposed in the first cross-beam. The system also includes a device. The device includes a shaft having the longitudinal axis, a first end, a second end, and a second radius greater than the first radius. The device also includes a connector attached to the first end of the shaft. The device also includes a rod connected to the shaft. The rod has a third end, a fourth end and a third radius less than the first radius. The third end is connected to the second end of the shaft. The rod is about parallel to the longitudinal axis. The device also includes a spring surrounding the rod. The spring is compressible or extendable along the longitudinal axis. The device also includes a stop connected to the rod at a position distal to the spring. The stop resists longitudinal compression or extension of the spring. The system also includes a girder connected to the connector. The rod is disposed through the hole. The spring is disposed between the cross-beam and the stop. Extension of the spring is constrained by the cross-beam.

The one or more embodiments also relate to a method of using a device. The device includes a shaft having the longitudinal axis, a first end, a second end, and a first radius. The device also includes a connector attached to the first end of the shaft. The device also includes a rod connected to the shaft. The rod has a third end, a fourth end and a second radius less than the first radius. The third end is connected to the second end of the shaft. The rod is about parallel to the longitudinal axis. The device also includes a spring surrounding the rod. The spring has a fifth end, a sixth end, and a third radius greater than the second radius. The spring is compressible or extendable along the longitudinal axis. The device also includes a stop connected to the rod at a position distal to the spring. The stop resists longitudinal compression or extension of the spring. Turning to the method, the method of using the device includes placing the rod through a hole in a cross-beam of a door frame having first and second beams connected by the cross-beam. The hole has a fourth radius greater than the second radius of the rod and less than the third radius of the spring. The method also includes sliding the spring over the rod such that the fifth end of the spring is proximate the cross-beam. The method also includes sliding a stop over the rod such that the sixth end of the spring is proximate the stop. The method also includes fixing the stop at a selected position on the rod. The method also includes suspending the connector of the device from a girder. At least a portion of a weight of the door frame compresses the spring with the fifth end of the spring against the cross-beam and the sixth end of the spring against the stop.

Other aspects of the invention will be apparent from the following description and the appended claims.

DETAILED DESCRIPTION

Figure 1:
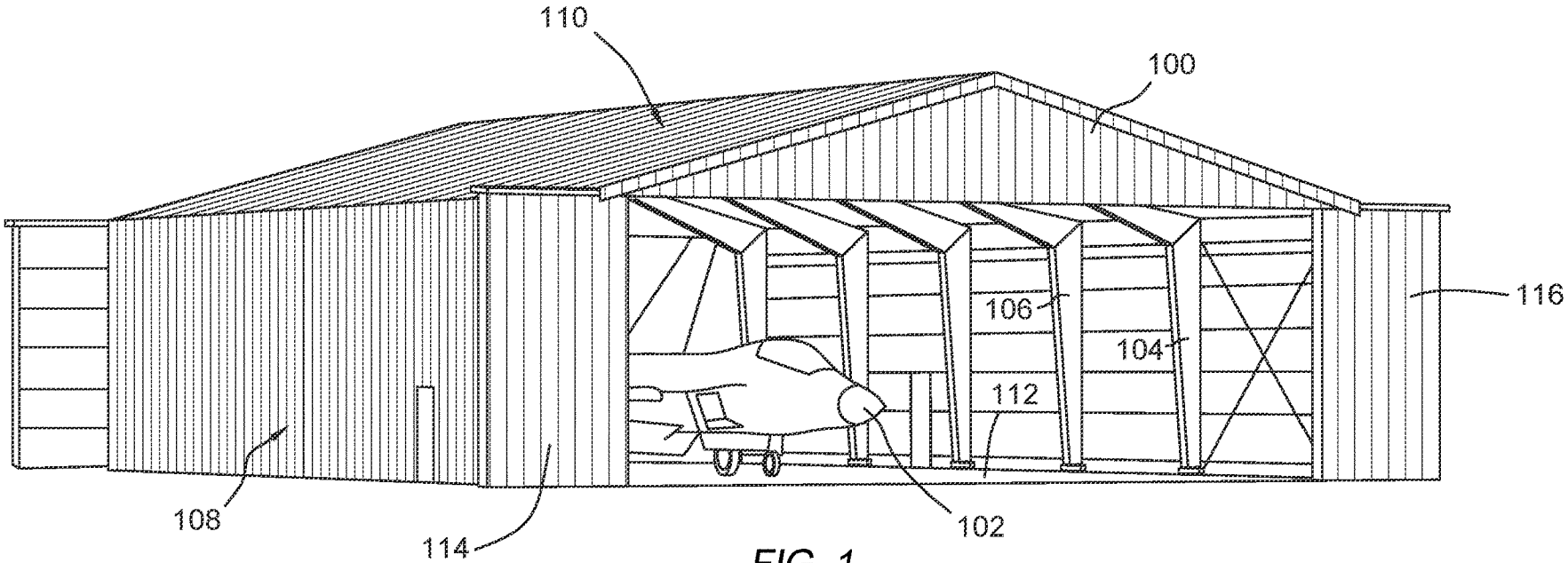
FIG. 1 shows a completed building in accordance with one or more embodiments.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

The term "about," when used with respect to a physical property that may be measured, refers to an engineering tolerance anticipated by or determined by an engineer or manufacturing technician of ordinary skill in the art. The exact quantified degree of an engineering tolerance depends on the product being produced and the technical property being measured. For a non-limiting example, two objects may be connected "at about" an apex of an A-frame if the two objects are connected to each other at a point within a pre-determined distance of the apex or within an acceptable engineering tolerance of the apex of the A-frame. In a non-limiting example, such a distance could be one centimeter. However, if an engineer determines that the engineering tolerance for a particular product should be tighter, then this value may be reduced. Likewise, engineering tolerances could be loosened in other embodiments, such that this value is increased. In any case, the ordinary artisan is capable of assessing what is an acceptable engineering tolerance for a particular product, and thus is capable of assessing how to determine the variance of measurement contemplated by the term "about."

In general, embodiments of the invention relate to a device for securing a door frame to a supporting structure. The device may be characterized as a girder trolley in some embodiments. The supporting structure may be an I-beam or other girder. The device may be a rod connected to a thicker shaft, with a spring disposed around the rod. One or more wheels may be attached to an opposing end of the shaft, with the wheel(s) resting on a flange of the I-beam, for example. In use, the rod is disposed through a hole in a crossbeam of the door frame. The spring is disposed between the cross beam and a stop (e.g., a lock nut) disposed at a distal end of the rod. The spring allows for smooth vertical movement of the door frame relative to the I-beam or girder, while the wheels allow for smooth horizontal movement of the door frame relative to the I-beam or girder.

FIG. 1 shows a completed building in accordance with one or more embodiments. As can be seen in the drawings, the building (100) includes a frame composed of support beams, such as support beam (104) and support beam (106). The building also includes siding, such as wall (108), and roof (110) attached to the frame. The building rests on a foundation (112).

In an embodiment, the frame and the siding of the building (100) are composed of steel. However, the building (100) could be composed of other construction materials, such as but not limited to, wood, composite materials, plastics, and other metals.

A first door (114) and a second door (116) are shown connected to the building (100). Either first door (114) or second door (116) may be connected to, hung from, or suspended from the building (100) by using the devices described with respect to FIG. 2, FIG. 5A, FIG. 5B, FIG. 5C, or FIG. 5D using the method described with respect to FIG. 4. Thus, the systems described with respect to FIG. 3, FIG. 6A, and FIG. 6B may show the details of how the first door (114) and the second door (116) are connected to the building (100). FIG. 3, FIG. 6A, and FIG. 6B also show how the first door (114) and the second door (116) are slidable with respect to the building (100) in order to open and close the doors.

The building (100) is shown as housing an aircraft (102). However, the building (100) could be used for any commercial or residential purpose.

Figure 2:
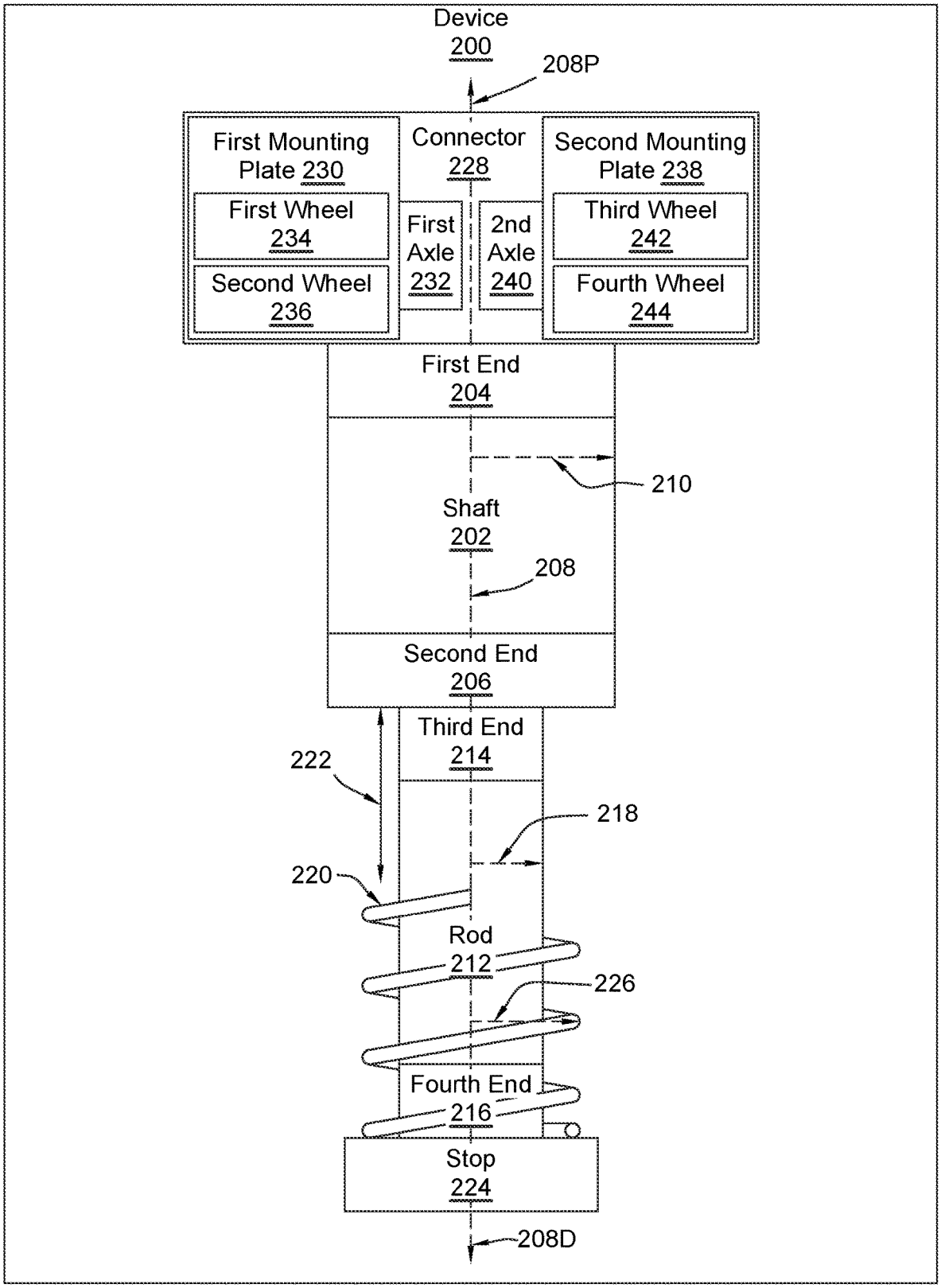
FIG. 2 a block diagram of a device useable to suspend a door shown in FIG. 1, in accordance with one or more embodiments.
Figure 3:
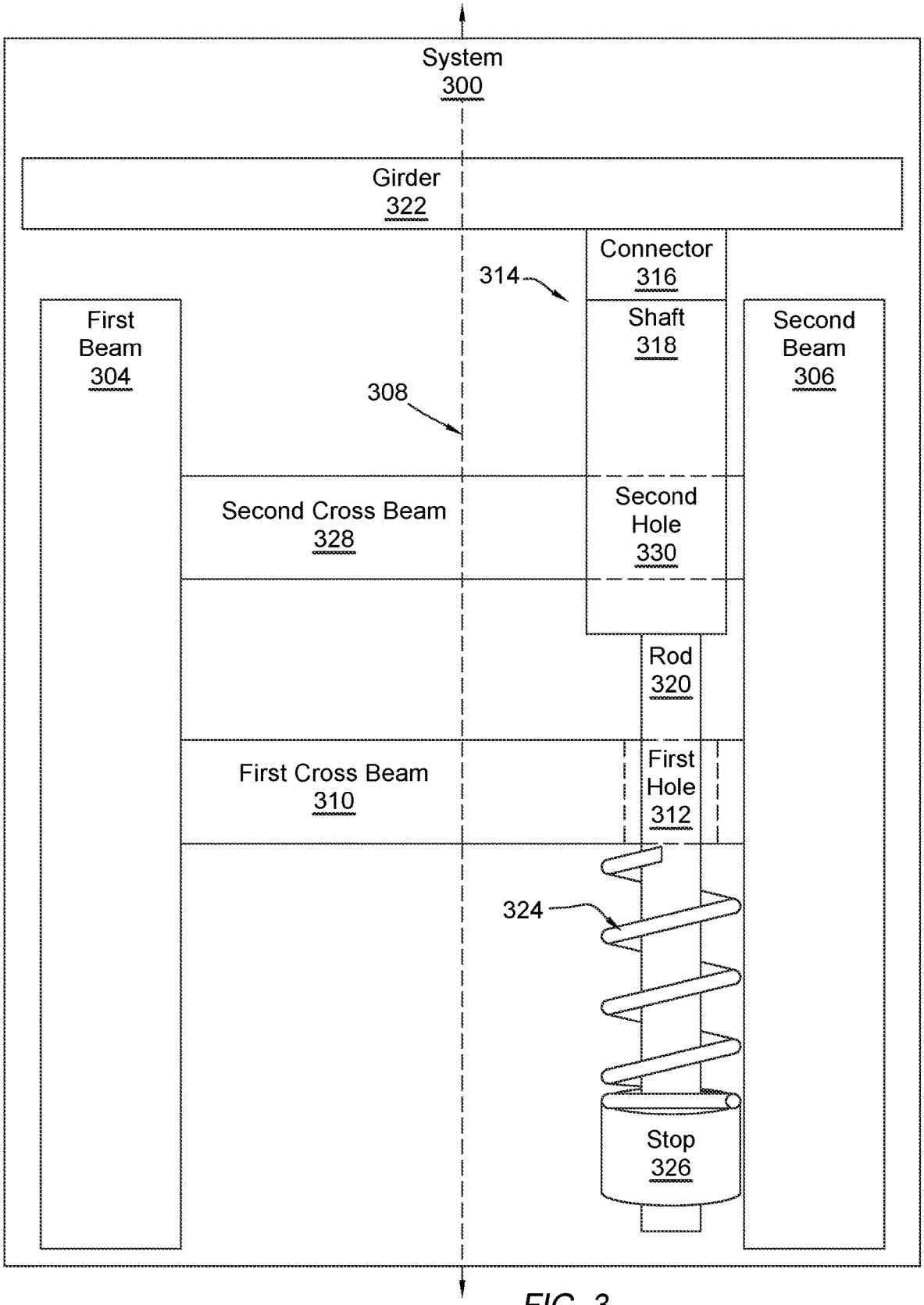
FIG. 3 shows a block diagram of a system including a door and a device for hanging the door, in accordance with one or more embodiments.

FIG. 2 a block diagram of a device useable to suspend a door shown in FIG. 1, in accordance with one or more embodiments. The device (200) may be characterized as a girder trolley in some embodiments. However, the device (200) is defined by the components that form the device together with the relationships among the components. Thus, the term "girder trolley," as used herein, does not necessarily imply any particular limitations.

The device (200) has a shaft (202) The shaft (202) may be a hollow or a solid elongated object. The shaft (202) may be cylindrical, though the cross section of the shaft (202) may have a variety of different shapes. The shaft (202) may be formed from a metal, though a variety of materials including but not limited to wood and composites could be used to form the shaft (202). In a specific embodiment, the shaft (202) may be a hollow cylindrical steel tube. If the shaft (202) is hollow, then a drain hole (not shown) may be placed at a convenient location, such as near or at the bottom of the second end (206) of the shaft (202) so that any water that enters the shaft (202) may drain.

Regardless of the shape or composition of the shaft (202), the shaft (202) is an elongated object defined by a first end (204), a second end (206), and a longitudinal axis (208) that lies through the elongated length of the shaft (202) between the first end (204) and the second end (206). In one embodiment one end of the longitudinal axis (208) (at arrow point 208P) may be characterized as a "proximate" end and the other end of the longitudinal axis (208) (at arrow point 208D) may be characterized as a "distal" end. However, the terms "proximate" and "distal" may be interchanged in another embodiment. The shaft (202) may be further defined by a first radius (210) which defines a "width" of the shaft (202) along an axis perpendicular to the longitudinal axis (208), as shown in FIG. 2.

The device also has a rod (212) connected to the shaft. The rod may be a hollow or a solid elongated object. The rod (212) may be formed from a metal, though a variety of materials including but not limited to wood and composites could be used to form the rod (212). In a specific embodiment, the rod (212) may be a solid cylindrical steel tube.

The rod (212) may be cylindrical, though the cross section of the rod (212) may have a variety of different shapes. In yet another embodiment, the rod (212) may have a shape other than a uniform length. For example, the rod (212) could be "L" or "U" shaped in order to constrain the spring (described further below) and also to accommodate other components in a door frame.

The rod (212) may share the longitudinal axis (208) with the shaft (202). However, the rod (212) may be offset from the longitudinal axis (208), such that the rod (212) has a different longitudinal axis (not shown) that is about parallel to the longitudinal axis (208). In an embodiment, a different axis of the rod (212) need not be parallel to the longitudinal axis (208). Thus, the term "about parallel to the longitudinal axis" refers to the shaft (202) having a different longitudinal axis that is offset from but parallel to the longitudinal axis (208). In yet another embodiment, the rod (212) could be attached to some other part of the shaft (202), such as a side wall of the shaft (202), such as if the rod (212) has a non-linear shape. Thus, the rod (212) need not be parallel to the longitudinal axis (208).

The rod (212) has a third end (214) and a fourth end (216). The third end (214) of the rod (212) may be connected to the second end (206) of the shaft (202), but in another embodiment may be connected to the shaft (202) at some other location, including the first end (204) or on some other side of the shaft (202). In the embodiment shown, the third end (214) of the rod is proximate to and connected to the second end (206) of the shaft, and the fourth end (216) of the rod (212) is distal to the second end (206) of the shaft.

The rod (212) may be further defined by a third radius (218) which defines a "width" of the rod (212) along another axis perpendicular to the longitudinal axis (208), as shown in FIG. 2. In an embodiment, the third radius (218) of the rod (212) is less than the first radius (210) of the shaft (202). However, in other embodiments, the radii may be adjusted so that they are equal or that the first radius (210) of the shaft (202) is less than the third radius (218) of the rod (212).

The rod (212) may be threaded. A threaded rod has corkscrew-shaped ridges disposed on the outer skin of the rod which allow a threaded nut to be screwed onto the rod (212), or to allow the rod (212) to be screwed into a threaded receiver. In an embodiment, a threaded receiver, which may be referred-to as a "threaded hole," is disposed in the second end (206) of the shaft (202). Thus, the third end (214) of the rod (212) is screwed into the shaft (202). However, other techniques may be used to secure the rod (212) to the shaft (202), such as but not limited to welding, using a continuously molded or formed structure instead of a joining structure, clamps, glues, etc.

A spring (220) may surround the rod. The spring (220) may be a helical spring which shares or is about parallel to the longitudinal axis (208), with the rod (212) disposed within the spring (220). The properties of the spring (220) shown in FIG. 2 may be varied. For example, the spring need not be helical, and may have a variety of different shapes. The number, width, and separation of the coils of the spring (220) may be varied. The spring constant of the spring (220) may be selected for a particular application, and thus may be varied. Nevertheless, regardless of the selected dimensions of the spring (220), the spring (220) is compressible or extendable along the longitudinal axis (208).

A length of the spring (220) along the longitudinal axis (208) may be varied. In an embodiment, the length of the spring (220) is less than a length of the rod (212) along the longitudinal axis (208). Thus, a space (222) may be created between a fifth end of the spring (220) and the second end (206) of the shaft (202). The space (222) may accommodate an expected location of a cross-beam, as shown, for example, with respect to FIG. 6A and FIG. 6B.

However, the length of the spring (220) may be varied. For example, a sixth end of the spring (220) distal to the fifth end of the spring (220) may not extend to the fourth end (216) of the rod (212). The spring (220) could extend entirely along the length of the rod (212). In contrast, the spring (220) may have a length greater than a corresponding length of the rod (212) along the longitudinal axis (208). In this case, addition of the stop (224), described below, may compress the spring (220) between the shaft (202) and the stop (224).

In an embodiment, compression or extension of the spring (220) may be constrained by the shaft (202) when the first radius (210) of the shaft (202) is greater than a corresponding radius (226) of the spring (220). Likewise, the stop (224) may also have a greater radius than the radius (226) of the spring (220), and likewise constrain compression or extension of the spring (220). However, as noted above, in an embodiment compression or extension of the spring (220) may be constrained between the stop (224) and a crossbeam (see FIG. 6A and FIG. 6B). In still another variation, the radius (226) of the spring (220) may be greater than the first radius (210) of the shaft (202). In this case, an additional stop attached to the shaft (202), or an additional flange or tab on the shaft (202), may constrain longitudinal compression or extension of the spring (220).

Attention is now turned to the stop (224). The stop (224) is connected to the rod (212) at a position distal to the spring (220). The stop (224) is an object having sufficient material strength to resist extension or compression of the spring (220). Thus, the stop (224) may be formed from metal, wood, composite materials, or possibly other substances. In a specific embodiment, the stop (224) may be a threaded steel nut having a flange for receiving a bottom surface of the spring (220).

However, many different stops could be used. For example, the stop (224) may be a flange integrally formed with a distal portion or distal end of the rod (212). The stop (224) may be a thickening portion of the rod (212). In this case, the spring (220) may be disposed over a proximal end of the rod (212) prior to the rod (212) being connected to the shaft (202). The stop (224) may be a clamp that is removably attached to the distal portion or distal end of the rod (212). Most generally, the stop (224) is any object which is fixed or fixable to the rod (212) with sufficient strength to resist longitudinal compression and/or expansion of the spring (220).

The stop (224) may be slidable along the rod (212) along the longitudinal axis (208). However, the stop (224) is also fixable to the rod (212) to resist longitudinal extension or compression of the spring (220). Examples of how to accomplish this arrangement are given below.

For example, the stop (224) may be a threaded flanged nut having a flange that resists the longitudinal extension of the spring (220). In this case the stop (224) may be screwed onto the threaded rod (212). The stop (224) is slidable along the rod (212) by screwing the spring (220) proximally or distally on the rod (212). The stop (224) is fixable to the rod (212) to resist the longitudinal compression or extension of the spring (220) in that the interlocking threads of the stop (224) and the rod (212) resist the stop (224) from moving along the longitudinal length of the rod (212) when the spring applies pressure to the stop (224).

In another example, as mentioned above, the stop (224) may be a clamp. In this case, the stop (224) is slidable along the rod (212) by releasing the clamp and sliding or otherwise moving the stop (224) to a new position along the longitudinal length of the rod (212). The stop (224) is fixable to the rod (212) to resist the longitudinal compression or extension of the spring (220) in that the force of the clamp the stop (224) from moving along the longitudinal length of the rod (212) when the spring applies pressure to the stop (224).

As mentioned above, still other types of stops may be used that satisfy desired properties of the rod (212). Thus, the examples given above do not limit the type of stop (224) that may be used.

Optionally, additional stops may be provided. For example, the stop (224) may include a second threaded nut screwed onto the threaded rod and disposed proximate the shaft. In other words, the second stop may be at another end of the rod (212) or even along the shaft (202).

Optionally, multiple springs could be provided with multiple additional stops. For example, a second spring may surround the shaft (202), with additional stops provided for the shaft (202) and/or the rod (212). Thus, the embodiments shown in FIG. 2 are exemplary only and may be varied.

The device (200) also include a connector (228). The connector (228) may be attached to the first end (204) of the shaft (202). However, the connector (228) may be connected to some other part of the shaft (202), or possibly even to the rod (212).

The connector (228) is composed of one or more components which allow the device (200) to be connected to some other object. In an embodiment, the connector (228) is sized and dimensioned to connect to a girder, such as an I-beam. For example, the connector (228) may be a clamp, threaded rod, or some other tool or set of tools for connecting the connector (228) to the other object.

In a specific embodiment, the connector (228) may be characterized as a trolley assembly. In this case, the connector (228) is connected to the shaft (202) proximate to the first end (204) of the shaft (202).

The connector (228) may include a first mounting plate (230) that may be connected to the shaft (202), and in particular to the first end (204) of the shaft (202). The first mounting plate (230) may be connected to the shaft (202) via a first axle (232), though any convenient method of connection may be used.

The first axle (232) may allow the first mounting plate (230) to rotate around an axis (a second axis) that extends radially from the shaft (202) about perpendicular to the longitudinal axis (208). Thus, the axis of rotation may be about parallel to the radii described above, and may be parallel to the first radius (210) of the shaft (202). In other words, the first axle (232) may allow the first mounting plate (230), and hence the connector (228), to swing into and out of FIG. 2 like a pendulum. Note that the axis of rotation of the first axle (232) need not be perpendicular to the longitudinal axis (208), but may be at some other angle relative to the longitudinal axis (208) of the shaft (202).

A first wheel (234) may be rotatably connected to the first mounting plate (230). The first wheel (234) allows the connector (228) (the trolley assembly) to roll along the flange of an I-beam girder, or along some other surface. The first wheel (234) may be replaced by a frictionless slider, a track system, or some other moveable or rotatable object in some embodiments. Optionally, a second wheel (236) may also be rotatably connected to the first mounting plate (230). More wheels could be added to the first mounting plate (230).

In either case, "rotatably" connected means that the first wheel (234) and/or the second wheel (236) may be free to spin about independent corresponding axes, which may be separate from an axis of rotation of the first axle (232). The axes of rotation of the first wheel (234) and/or the second wheel (236) need not be parallel to either the axis of rotation of the first axle (232) or the first radius (210) of the shaft (202). Rather, the axes of rotation may be set at whatever angle deemed appropriate by the mechanical engineer in order to accommodate different shapes of the girder or other object to which the connector (228) is attached.

Other objects may form the trolley assembly that forms the connector (228). For example, the connector (228) may also include a second mounting plate (238).

The second mounting plate (238) may be connected to the first end (204) of the shaft (202) via a second axle (240) extending radially from the first end (204) of the shaft (202). The second axle (240) may be rotatably connected, as described above with respect to the first axle (232). The axis of rotation of the second axle (240) may be the same or different than the axis of rotation of the first axle (232). The first axle (232) and the second axle (240) may be independently rotatable. Alternatively, the first axle (232) and the second axle (240) may be different sides of a single axle that extends through the shaft (202). In this case, the first axle (232) and the second axle (240) may rotate together in tandem.

A third wheel (242) may be rotatably connected to the second mounting plate (238). Like the first wheel (234), the third wheel (242) may have its own axis of rotation which may be different than the above-described axes. Optionally, a fourth wheel (244) may be connected to the second mounting plate (238) in a similar manner. More wheels may be rotatably connected to the second mounting plate (238). Optionally, the wheels may be replaced by tracks, sliders, or other means for allowing the second mounting plate (238) to slide along a flange of an I-beam girder or other object to which the connector (228) is connected.

FIG. 3 shows a block diagram of a system including a door and a device for hanging the door, in accordance with one or more embodiments. The system (300) described with respect to FIG. 3 may use the device (200) described with respect to FIG. 2. Thus, terms used with respect to device (314) of FIG. 3 correspond to and have similar descriptions as the same terms used with respect to the device (200) of FIG. 2. For clarity, the individual components of the device (314) are not shown in FIG. 3, but rather are shown in FIG. 2.

The system (300) includes a door frame (302). The door frame (302) includes a first beam (304), which is about parallel to a second beam (306). Each of the first beam (304) and the second beam (306) may be formed from a material suitable for the intended purpose of the door, such as but not limited to metal, wood, composite materials, plastic, drywall, etc. In an embodiment, the first beam (304) and the second beam (306) are steel girders or beams.

The first beam (304) and the second beam (306) are each about parallel to a longitudinal axis (308). The longitudinal axis (308) may be the same as the longitudinal axis (208) of FIG. 2, but another embodiments may be different.

The system (300) also includes a first cross-beam (310). The first cross-beam (310) may be formed from a material suitable for the intended purpose of the door, such as but not limited to metal, wood, composite materials, plastic, drywall, etc. In an embodiment, the first cross-beam (310) is a steel girder or beam.

A first hole (312) may be disposed through the first cross-beam (310). The first hole (312) may have a first radius.

The system (300) may also include a device (314). The device (314) may be the device (200) of FIG. 2. Only the connector (316), the shaft (318), and the rod (320) of the system (300) are shown for clarity. Other components of the device (314) may be as described with respect to device (200) of FIG. 2.

A second radius of the shaft of the device (314) may be greater than the first radius of the first hole (312). In other embodiments, the second radius of the shaft may be less than the first radius of the first hole (312).

The system also includes a girder (322) that may be connected to the connector (316). The girder (322) may be a steel I-beam, or may be some other beam formed from possibly different materials. In an embodiment, the girder (322) may be a joist or other beam supporting the door frame (i.e., the first beam (304), the second beam (306), and the first cross-beam (310)).

The rod (320) may be disposed through the first hole (312). The spring (324) of the device (314) surrounds the rod between the first cross-beam (310) and the stop (326) of the device (314).

The radius of the spring (324) is greater than the radius of the first hole (312). The radius of the stop (326) may also be greater than the radius of the first hole (312). However, the stop may have some other size, dimension, or feature which constrains compression and extension of the spring (324) past the stop (326). As explained with respect to FIG. 2, the stop (326) may be slidable along and fixable to the rod (320) in order to change how much the spring (324) is compressed or to change a distance between the spring (324) and the first cross-beam (310).

In use, a weight of the door frame (i.e., the first beam (304), the second beam (306), and the first cross-beam (310)) forces the first cross-beam (310) against one end of the spring (324). This same weight compresses the spring (324) against the stop (326). Thus, in use, a change in vertical force against the door frame will cause further compression or extension in the spring (324). For this reason, the door may move upwardly and downwardly relative to the girder (322) as the door frame slides horizontally with respect to the girder (322).

The sliding of the door frame takes place via the connector (316). In an embodiment, as described above with respect to FIG. 2, the connector (316) may be a trolley assembly. Additionally, the girder (322) may be an I-beam having one or more flanges. Thus, in an embodiment, the wheel(s) of the trolley assembly of the connector (316) may roll along the flange(s) of the girder (322). The rolling may enable the door frame to slide back and forth horizontally along the girder (322).

Additionally, if the connector (316) also includes one or more rotatable axes, as shown in FIG. 2, then the device (314) may swing back and forth in a pendulum-like motion. From the perspective of FIG. 3, the device (314) may swing to the left and to the right. Thus, the device (314) may allow for variations in movement both vertically and horizontally as the door frame is slid horizontally relative to the girder (322).

In an embodiment, the system (300) may include a second cross-beam (328). The second cross-beam (328) may reinforce the door frame by providing additional support between the first beam (304) and the second beam (306). The second cross-beam (328) may also reinforce the position of the device (314) with respect to the door frame. For example, the second cross-beam (328) may be provided with a second hole (330) having a radius that is greater than the shaft (318) of the device (314). In this manner, horizontal movement of the shaft (318) with respect to the first beam (304) and the second beam (306) may be constrained without preventing the shaft (318) from sliding vertically with respect to the girder (322) through the second hole (330).

The arrangement shown in FIG. 3 may be varied. For example, the spring (324) may extend through the first cross-beam (310) and to the shaft (318). The spring (324) may extend to the connector (316), or even the girder (322), in other embodiments.

Figure 4:
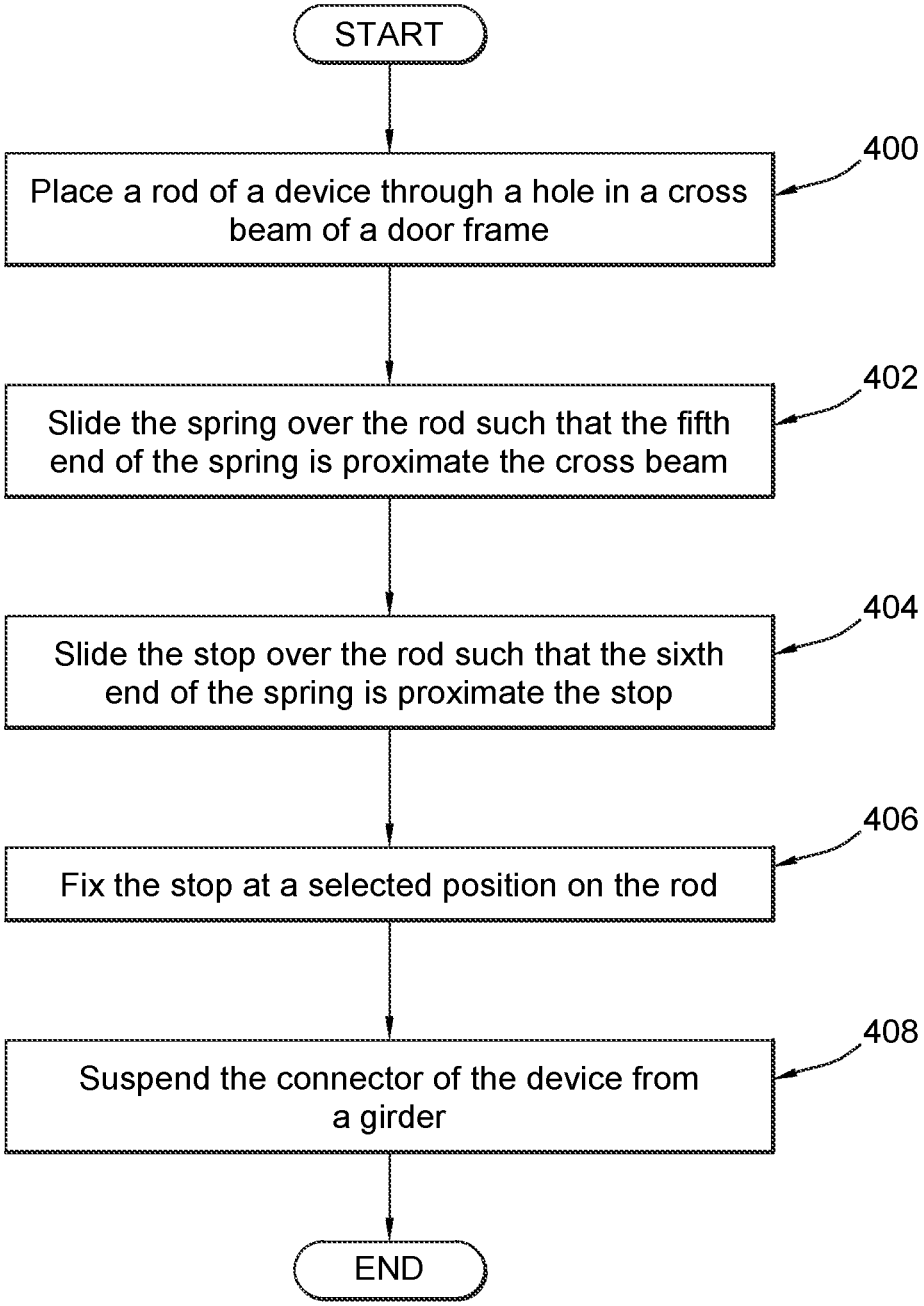
FIG. 4 shows a method of hanging a door using the device shown in FIG. 2, in accordance with one or more embodiments.
Figure 5A:
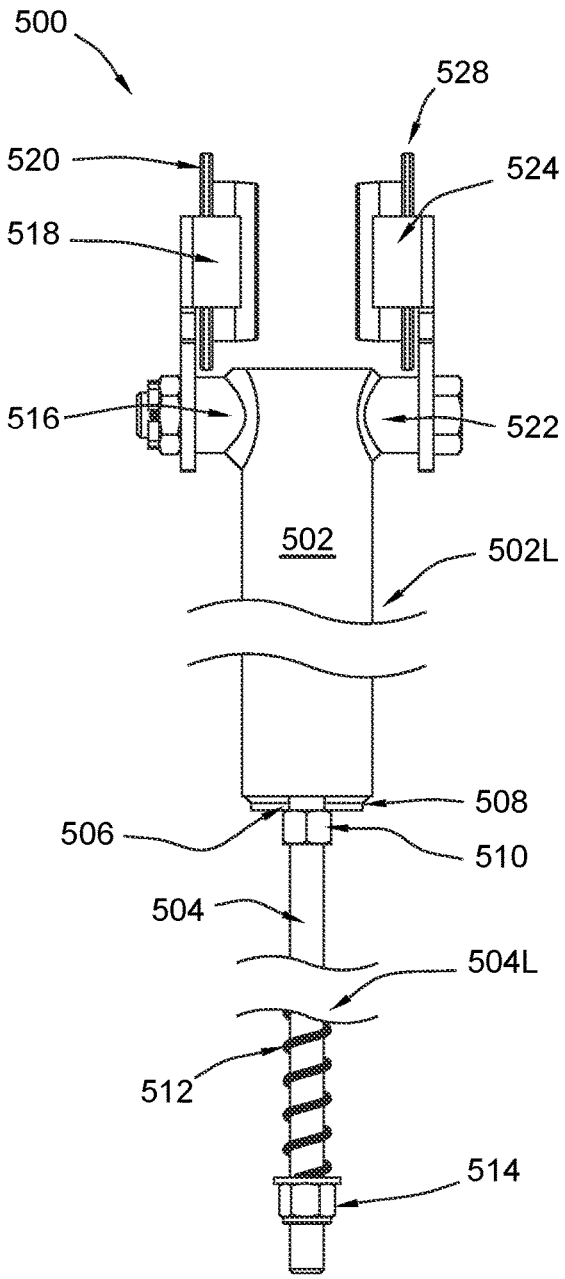
FIG. 5A, FIG. 5B, FIG. 5C, and FIG. 5D show examples of the device described with respect to FIG. 2, in accordance with one or more embodiments.
Figure 5B:
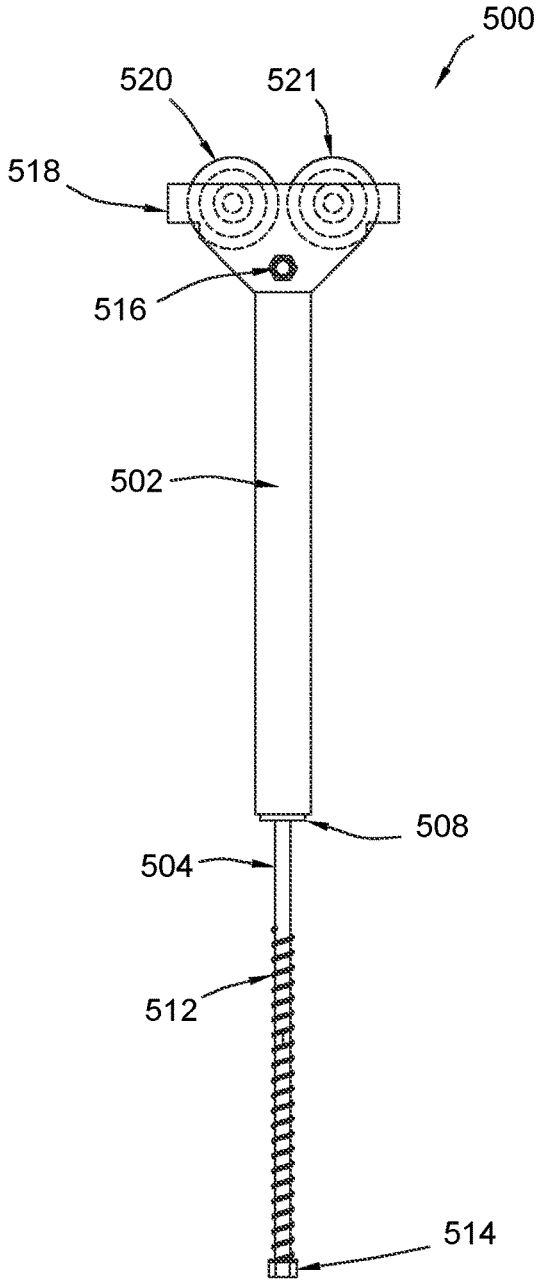

FIG. 4 shows a method of hanging a door using the device shown in FIG. 2, in accordance with one or more embodiments. The method of FIG. 4 may be implemented using the system shown in FIG. 3.

At step 400, the rod of the device is placed through a hole in a cross-beam of a door frame. Again, the hole has a radius greater than the radius of the rod and less than the radius of the spring.

At 402, the spring is slid over the rod such that the end of the spring is proximate the cross-beam. Thus, the spring and the rod may be concentric, with the coils of the spring surrounding the rod.

At 404, the stop is slid over the rod such that the end of the spring is proximate the stop. The term "slid" contemplates screwing a threaded nut (the stop) onto a threaded rod. The term "slid" also contemplates releasing a clamp of the stop from the rod, moving the stop, and then reattaching the clamp to the rod. Thus, the terms "slid" or "slide" contemplate types of movement more than simply smoothly moving the stop along the rod.

At 406, the stop is fixed at a selected position on the rod. The term "fixed" contemplates the interlocking threads of the rod and the stop preventing the stop from moving along the rod without twisting the stop and/or rod. The term "fixed" also contemplates clamping the stop to the rod, using a pin through the stop and rod to secure movement of the stop relative to the rod, welding, glue, or other types of methods for preventing the stop from moving along the rod. Thus, the term "fixed" contemplates being both removable fixed and permanently fixed.

At 408, the connector of the device is suspended from a girder. In this manner, a weight of the door frame compresses the spring with an end of the spring against the cross-beam and the opposing end of the spring against the stop. Thus, in one embodiment, at least part of the weight of the door frame is born by and compresses the spring. Suspending the connector from the girder may be accomplished by resting wheels of the connector on the flange of an I-beam girder, by clamping the connector to the girder, by using a rope or hanger connecting the connector to the girder, or by any other direct or indirect connection device between the connector and the girder or other component of the building.

The method of FIG. 4 may be extended. For example, the position of the device (e.g. the girder trolley) relative to the door frame may be reinforced by using a second cross-beam that may be about parallel to the first cross-beam. The second cross-beam may have a second hole. In this case, the shaft of the device may be disposed through the second hole, thereby at least partially constraining the device from moving horizontally relative to the door frame.

In another example, the connector may include a trolley assembly having a wheel. When the girder is an I-beam having a flange, the wheel or wheels of the trolley assembly may rest on the flange. The door frame and the device then roll on the flange of the I-beam as the door frame slidably moves horizontally relative to the I-beam. In this case, vertical movement of the door frame relative to the I-beam is constrained by compression and extension of the spring. Because the spring is compressible, variations in vertical movement may accommodate height variations in the floor, or in the height of the girder relative to the floor.

Yet further, the connector of the device may include mounting plates attached to the shaft via one or more axels, such as shown in FIG. 2, FIG. 5A, FIG. 5B, and FIG. 5C. In this case, the device may also rotate along the axels. Thus, the device enables the door frame to accommodate variations in horizontal movement of the door frame relative to the girder.

FIG. 5A, FIG. 5B, FIG. 5C, and FIG. 5D show examples of the device described with respect to FIG. 2, in accordance with one or more embodiments. Thus, device (500) may be an example of device (200) of FIG. 2. Because FIG. 5A through FIG. 5D refer to different views of the same device, common reference numerals are used with respect to FIG. 5A through FIG. 5D.

Turning first to FIG. 5A, FIG. 5B, FIG. 5C, and FIG. 5D, four views of the same device (500) are shown. While, FIG. 5A through FIG. 5D show some different features for clarity, and are presented at different magnifications or with different proportions for clarity, FIG. 5A through FIG. 5D refer to the same device. Thus, FIG. 5A through FIG. 5D share common reference numerals.

The device (500) includes a hollow cylindrical shaft (502) formed from steel. Double-dashed lines (502L) in FIG. 5A indicate that the length of the hollow cylindrical shaft (502) may be varied relative to other components shown for the device (500).

A solid threaded rod (504) is connected to the hollow cylindrical shaft (502). Double-dashed lines (504L) in FIG. 5A indicate that the length of the solid threaded rod (504) may be varied relative to other components shown for the device (500). The solid threaded rod (504) is screwed into a threaded receiver (506) in a circular steel plate (508) defining the terminal end of the hollow cylindrical shaft (502). In this manner, the solid threaded rod (504) is removably connected to the hollow cylindrical shaft (502).

Optionally, a nut (510) may be screwed onto the solid threaded rod (504) and placed against the circular steel plate (508). The nut (510) may be a locknut in order to aid in securing the solid threaded rod (504) to the hollow cylindrical shaft (502). In another embodiment, the nut (510) may be disposed in a more distal location along the length of the solid threaded rod (504).

A steel spring (512) surrounds at least part of the length of the solid threaded rod (504). The length of the steel spring (512) may be varied, as described above. However, in the embodiments shown, the steel spring (512) is less than the length of the solid threaded rod (504), because it is intended that the solid threaded rod (504) will be disposed through a hole in a cross-beam and that the steel spring (512) will rest against crossbeam at one end, and against an adjustment nut (514) at the other end. See FIG. 6A and FIG. 6B for this arrangement.

The adjustment nut (514) is an example of the stop (224) mentioned in FIG. 2 or the stop (326) mentioned in FIG. 3. However, in other embodiments, the adjustment nut (514) may be replaced by some other type of stop, such as those stops described with respect to FIG. 2.

The adjustment nut (514) is screwed onto the end of the solid threaded rod (504) after the now concentric steel spring (512) has been slid over the solid threaded rod (504). In this manner, the steel spring (512) is secured in place on the solid threaded rod (504). To show that the location of the adjustment nut (514) is slidable along the rod (via screwing the adjustment nut (514) along the solid threaded rod (504)) FIG. 5A and FIG. 5B show different locations of the adjustment nut (514). In particular, FIG. 5A shows the adjustment nut (514) being located more proximal along the solid threaded rod (504). FIG. 5B shows the adjustment nut (514) being located more distal along the solid threaded rod (504).

Turning to the other end of the hollow cylindrical shaft (502), a first axle (516) is rotatably connected to the hollow cylindrical shaft (502) and is attached to a first mounting plate (518). The first axle (516) is rotatable with respect to the hollow cylindrical shaft (502) about an axis that is about perpendicular to a longitudinal axis of the hollow cylindrical shaft (502). In other words, the first axle (516) allows the hollow cylindrical shaft (502) and/or the first mounting plate (518) to swing into and out of FIG. 5A in a pendulum-like motion. From a different perspective, the arrangement allows the hollow cylindrical shaft (502) and/or the first mounting plate (518) to swing from side to side relative to FIG. 5B in the pendulum-like motion. At least one wheel (520) is rotatably connected to the first mounting plate (518). The at least one wheel (520) rotates about an axis about parallel to the axis of rotation of the first axle (516). In FIG. 5B, the at least one wheel (520) is shown to be two wheels: the at least one wheel (520), plus an additional wheel (521).

Similarly, a second axle (522) is rotatably connected to the hollow cylindrical shaft (502) and is fixedly attached to a second mounting plate (524). The first axle (516) and the second axle (522) may rotate independently of each other. The second axle (522) is rotatable with respect to the hollow cylindrical shaft (502) about an axis that is about perpendicular to a longitudinal axis of the hollow cylindrical shaft (502). In other words, the second axle (522) allows the hollow cylindrical shaft (502) and/or the second mounting plate (524) to swing into and out of FIG. 5A in a pendulum-like motion, or from side-to-side from the perspective of FIG. 5B.

At least one second wheel (528) is rotatably connected to the second mounting plate (524). The at least one second wheel (528) rotates about an axis about parallel to the axis of rotation of the second axle (522). The at least one second wheel (528) may also be two wheels to match the number of wheels shown mounted on the first mounting plate (518).

Figure 5C:
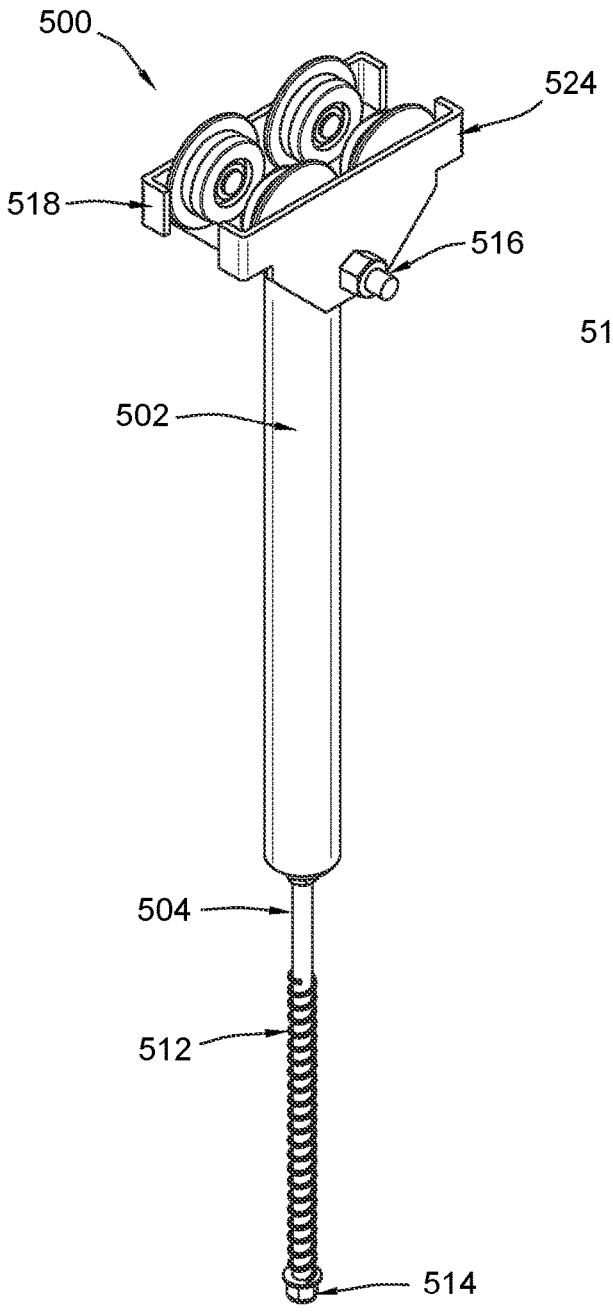
Figure 5D:
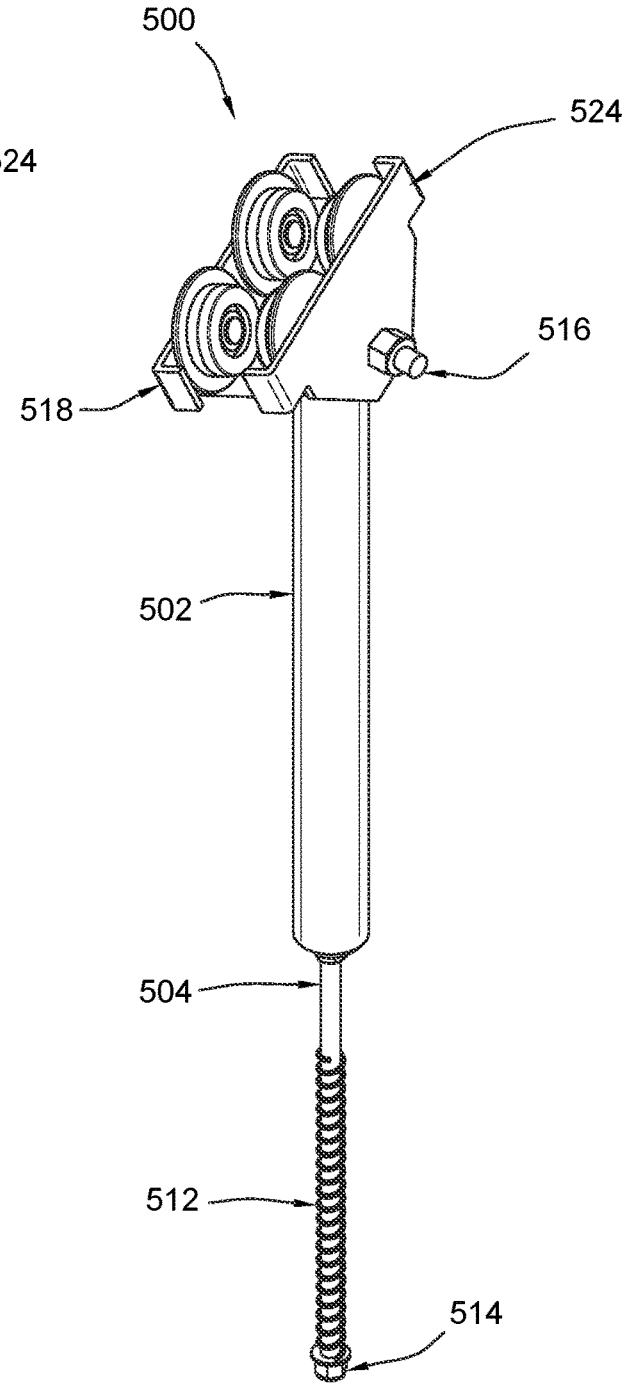
Figure 6B:
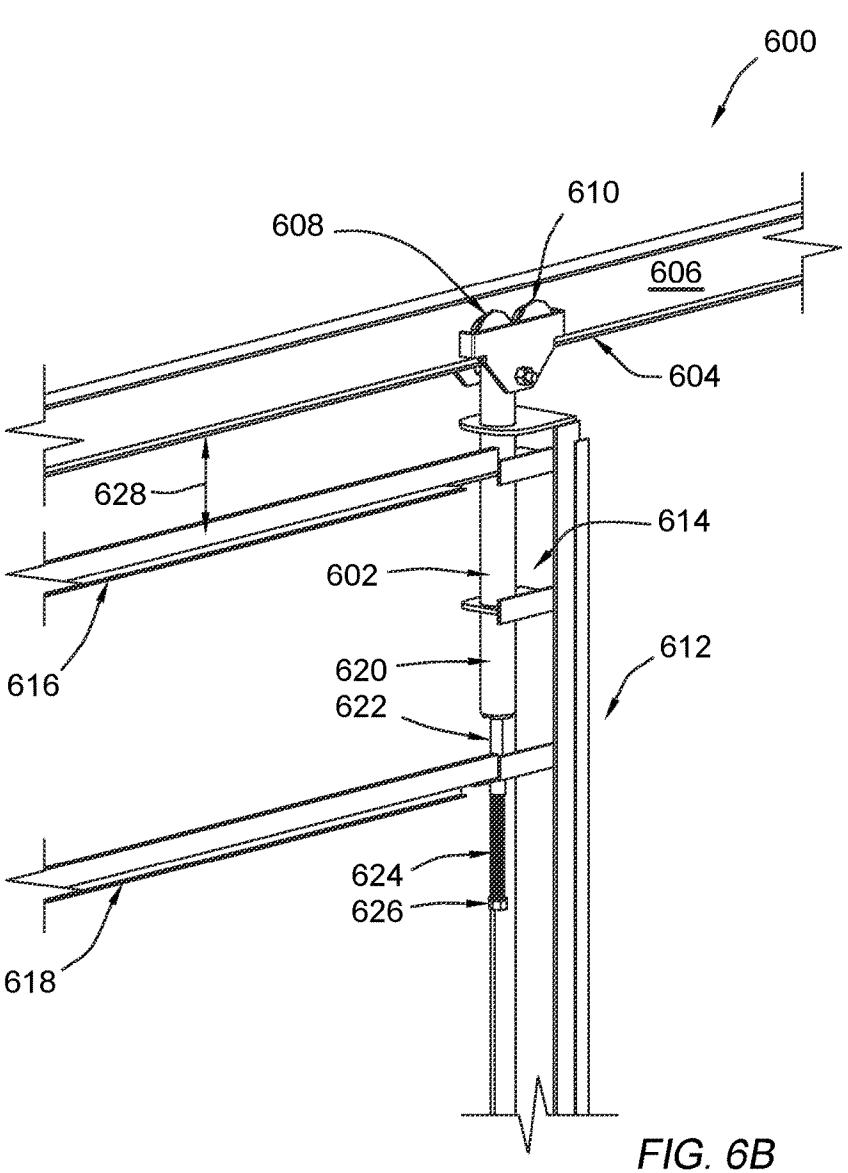
FIG. 6A and FIG. 6B show examples of the system described with respect to FIG. 3, in accordance with one or more embodiments.
Figure 6A:
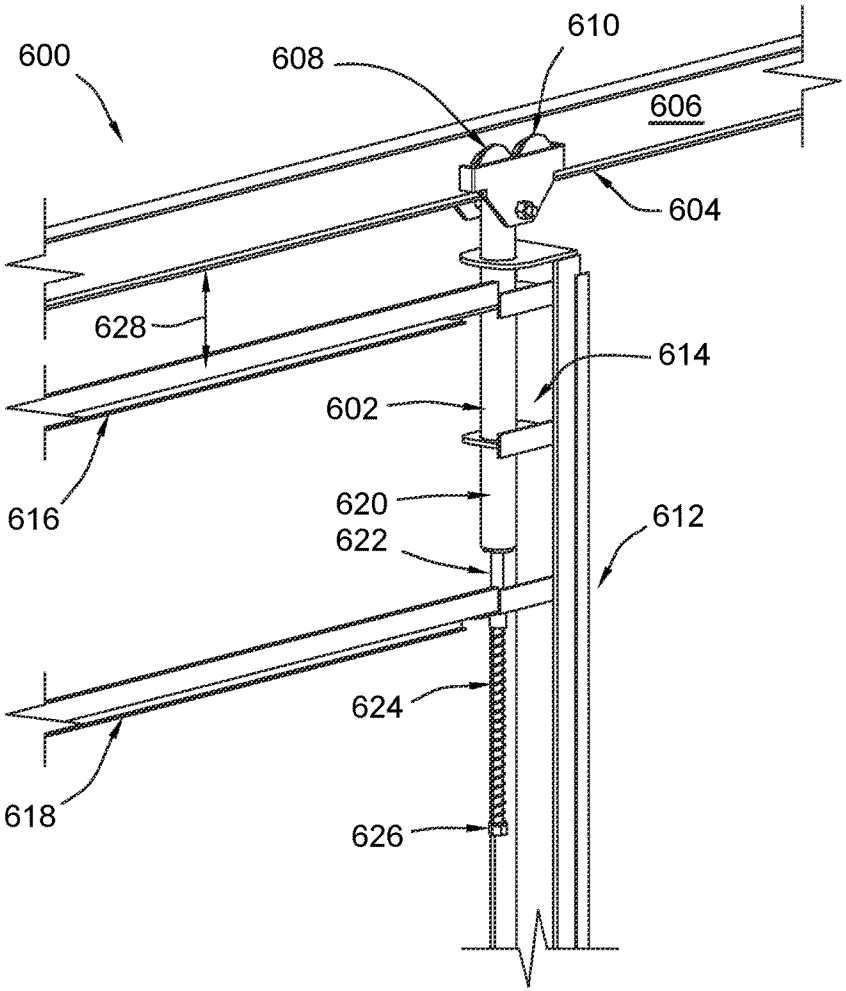

FIG. 5C and FIG. 5D show this rotation by showing still different views of the device (500). FIG. 5D shows the rotation, relative to FIG. 5C, of the first mounting plate (518) and the second mounting plate (524) about the first axle (516) and the second axle (522) (the second axle (522) is shown FIG. 5A, but not shown in FIG. 5C and FIG. 5D). Note that while FIG. 5C and FIG. 5D show the same degree of rotation of both the first mounting plate (518) and the second mounting plate (524), the first mounting plate (518) and the second mounting plate (524) may be rotate independently relative to the hollow cylindrical shaft (502). Thus, the degree of rotation of the first mounting plate (518) need not be the same as the degree of rotation of the second mounting plate (524).

The rotations of the first mounting plate (518) and the second mounting plate (524) with respect to the hollow cylindrical shaft (502) allows the device (500) to accommodate changes in shape along flanges of an I-beam on which the device (500) rolls. Similarly, the arrangement accommodates differences in an angle of the ground or foundation relative to the flange of the I-beam along which the device (500) rolls.

FIG. 6A and FIG. 6B show examples of the system described with respect to FIG. 3, in accordance with one or more embodiments. FIG. 6A and FIG. 6B show the same door system (600) shown in two different positions, vertically extended and vertically relaxed. Thus, FIG. 6A and FIG. 6B refer to the same objects and share common reference numerals.

The device (602) shown in FIG. 6A and FIG. 6B may be device (200) shown in FIG. 2, or device (500) shown in FIG. 5 through FIG. 5D. FIG. 6A and FIG. 6B taken together illustrate an example of the system described with respect to FIG. 3 and the method of use described with respect to FIG. 4.

The device (602) rests on the flange (604) of a I-beam girder (606). In particular, the wheels, such as first wheel (608) and second wheel (610), rest on and are rollable along the flange (604). An opposing pair of wheels are similarly disposed on the opposing flange on the other side of the I-beam girder (606), though are not shown for clarity.

The device (602) is also secured to a door frame (612). The door frame (612) includes a first beam (614). The first beam (614) in FIG. 6A and FIG. 6B is about perpendicular to the I-beam girder (606); however, the angle between the two components may be varied in other embodiments. The door frame (612) may include a second beam (not shown) disposed opposite the first beam (614). For example, see the arrangement of first beam (304) and second beam (306) in FIG. 3.

The door frame (612) in this example includes two cross-beams, first cross-beam (616) and second cross-beam (618). The cross-beams are fixed to the first beam (614) and to the second beam (not shown), and may be parallel to each other.

To secure the device (602) to the door frame (612), the shaft (620) and the rod (622) of the device (602) are disposed through holes in the cross-beams, as shown. The holes are sized and dimensioned to have radii larger than the corresponding radii of the device (602) and the rod (622), yet still restrain horizontal movement of the device (602) and the rod (622). In other words, the door frame (612) is permitted to move up and down (i.e., along the longitudinal axis of the device (602)) relative to the device (602). However, the device (602) is constrained from moving from side to side (i.e., along a direction parallel to a radius of the shaft (620) or the rod (622)) relative to the door frame (612). The radii of the holes in the cross-beams thus may vary with the changing radii of the shaft (620) and the rod (622).

The spring (624) is disposed around the distal portion of the rod (622). In longitudinal length, the spring (624) extends between the second cross beam (618) and an adjustment nut (626) disposed at or near a distal end of the rod (622).

In use, most of the combined weight of the device (602) and the door frame (612) is supported by the ground or foundation upon which the door frame (612) rests. Rollers or sliders (not shown) on the bottom of the door frame (612) may further facilitate the door frame (612) to slide horizontally along the ground or foundation (or along a track mounted to the ground or foundation).

However, the ground or foundation and the I-beam girder (606) may have vertical variations with respect to each other. When the distance between the ground or foundation and the I-beam girder (606) increases, more of the weight of the door frame (612) will fall onto the wheels of the device (602) and onto the spring (624). As a result, the spring (624) will compress under the increasing force caused by more of the weight of the door imposed on the device (602). In turn, the distance (628) between the door frame (612) and the I-beam girder (606) will increase as door frame (612) slides vertically with respect to the shaft (620) and the rod (622) of the device (602). The compression of the spring (624) provides additional support for the weight of the door frame (612), and also smooths the vertical movement of the door frame (612).

When the distance between the foundation and the I-beam girder (606) decreases, more of the weight of the door frame (612) will be supported directly by the ground or foundation. Less of the weight of the door frame (612) will be applied to the device (602). As a result, the spring (624) will expand. Also, the distance (628) between the door frame (612) and the I-beam girder (606) will decrease as the door frame (612) slides vertically with respect to the shaft (620) and the rod (622) of the device (602).

Note that the overall length of the device (602) does not change during either process in this specific example, though in some embodiments it is possible to arrange components in the device (602) such that the length of the device (602) may change during compression and expansion of the spring (624). Rather, in this example, only the spring (624) is compressed and expands during vertical movement of the door frame (612) relative to the I-beam girder (606). Regardless of the vertical movement of the door frame (612), the first wheel (608) and the second wheel (610) roll along the flange (604) of the I-beam girder (606) as the door frame (612) moves horizontally with respect to the I-beam girder (606).

The responsiveness of the spring (624) with respect to changes in the distance (628) between the first cross beam (616) and the flange (604) may be adjusted by changing the position of the adjustment nut (626) along the longitudinal length of the rod (622). Tightening the adjustment nut (626) may place additional tension on the spring (624). In turn, loosening the adjustment nut (626) may relieve some tension on the spring (624).

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A device comprising:
a shaft having a longitudinal axis, a first end, and a second end;
a connector attached to the first end of the shaft;
a rod connected to the shaft, wherein:
the rod comprises a third end and a fourth end,
the third end is connected to the second end of the shaft, and
the rod is offset from the longitudinal axis of the shaft, and remains about parallel to the longitudinal axis;
a spring surrounding the rod, wherein the spring is compressible or extendable along the longitudinal axis; and
a stop connected to the rod at a position distal to the spring, wherein the stop resists longitudinal compression or extension of the spring.

2. The device of claim 1, wherein the stop is slidable along the rod along the longitudinal axis.

3. The device of claim 2, wherein:
the rod comprises a threaded rod, and
the stop comprises a threaded flanged nut having a flange that resists the longitudinal extension of the spring, the threaded flanged nut screwed onto the threaded rod.

4. The device of claim 3, wherein the second end of the shaft comprises a threaded hole, and wherein the threaded rod is screwed into the threaded hole.

5. The device of claim 4, further comprising:
a second threaded nut screwed onto the threaded rod and disposed proximate the shaft.

6. The device of claim 1, wherein the rod shares the longitudinal axis of the shaft.

7. The device of claim 1, wherein the connector comprises a clamp.

8. The device of claim 1, wherein the connector comprises:
a trolley assembly connected to the shaft, proximate to the first end of the shaft.

9. The device of claim 8, wherein the trolley assembly comprises:
a first mounting plate connected to the shaft; and
a wheel connected to the mounting plate.

10. The device of claim 9, wherein the trolley assembly further comprises:
a first axle connecting the first end of the shaft to the first mounting plate, wherein:
the first axle extends radially from the shaft along a second axis about perpendicular to the first axis, and
the first axle is rotatable about the second axis.

11. The device of claim 10, wherein the mounting plate further comprises:
a second wheel connected to the mounting plate.

12. The device of claim 11, further comprising:
a second axle extending radially from the first end of the shaft along the second axis;
a second mounting plate connected to the second axle;
a third wheel connected to the second mounting plate; and a fourth wheel connected to the second mounting plate, wherein the second axle is rotatable about the second axis.

13. A system comprising:

a door frame comprising a first beam about parallel to a second beam, the first beam and the second beam about parallel to a longitudinal axis;

a first cross-beam connecting the first beam and the second beam, wherein a first hole having a first radius is disposed in the first cross-beam;

a device comprising:

a shaft having the longitudinal axis, a first end, a second end, and a second radius greater than the first radius;

a connector attached to the first end of the shaft;

a rod connected to the shaft, wherein:

the rod comprises a third end, a fourth end and a third radius less than the first radius, the third end is connected to the second end of the shaft, and the rod is about parallel to the longitudinal axis;

a spring surrounding the rod, wherein the spring is compressible or extendable along the longitudinal axis; and a stop connected to the rod at a position distal to the spring, wherein the stop resists longitudinal compression or extension of the spring;

a girder connected to the connector, wherein:

the rod is disposed through the hole, the spring is disposed between the cross-beam and the stop, and extension of the spring is constrained by the crossbeam; and a second cross-beam connecting the first beam and the second beam, wherein:

the second cross-beam is about parallel to the first cross-beam, a second hole having a fifth radius is disposed in the second cross-beam, the fifth radius is greater than the second radius of the shaft, the shaft is disposed through the second hole, and the shaft is slidable through the hole during compression or extension of the spring.

14. The system of claim 13, wherein the girder comprises an I-beam having a flange, and wherein the connector comprises:

a trolley assembly connected to the shaft, proximate to the first end of the shaft, the trolley assembly comprising:

a first mounting plate connected to the shaft; and a wheel connected to the mounting plate, wherein the wheel rests on and is rollable along the flange.

15. The system of claim 14, wherein the trolley assembly further comprises:

a first axle connecting the first end of the shaft to the first mounting plate, wherein:

the first axle extends radially from the shaft along a second axis about perpendicular to the first axis, and the first axle is rotatable about the second axis to allow rotation of the device relative to the girder.

* * * * *